US009187162B2

(12) United States Patent
Stella

(10) Patent No.: US 9,187,162 B2
(45) Date of Patent: Nov. 17, 2015

(54) AIR INTAKE DEVICE

(75) Inventor: Vittorio Stella, Ferrara (IT)

(73) Assignee: CALZONI S.r.l. (IT)

( * ) Notice: Subject to any disclaimer, the term of this patent is extended or adjusted under 35 U.S.C. 154(b) by 706 days.

(21) Appl. No.: 13/529,586

(22) Filed: Jun. 21, 2012

(65) Prior Publication Data

US 2015/0122168 A1 May 7, 2015

(30) Foreign Application Priority Data

Jun. 29, 2011 (IT) ..... BO2011A0383

(51) Int. Cl.
*B63G 8/36* (2006.01)
*B63G 8/38* (2006.01)

(52) U.S. Cl.
CPC .. *B63G 8/36* (2013.01); *B63G 8/38* (2013.01); *B63B 2221/24* (2013.01)

(58) Field of Classification Search
CPC ..... B63G 8/36; B63G 8/38
USPC ..... 114/312, 313, 334, 339, 340
See application file for complete search history.

(56) References Cited

U.S. PATENT DOCUMENTS

| | | | | |
|---|---|---|---|---|
| 7,209,288 | B2 | 4/2007 | Waentig et al. | |
| 8,960,118 | B2 * | 2/2015 | Stella | 114/339 |
| 2013/0269586 | A1 * | 10/2013 | Stella | 114/339 |

FOREIGN PATENT DOCUMENTS

| | | |
|---|---|---|
| DE | 19535873 | 4/1997 |
| DE | 103 14 057 | 5/2004 |
| DE | 10 2007 021189 | 7/2008 |
| EP | 0372265 | 6/1990 |
| EP | 1162137 | 12/2001 |
| EP | 1462360 | 9/2004 |
| EP | 1468906 | 10/2004 |
| EP | 1 506 921 | 2/2005 |
| FR | 2 271 428 | 12/1975 |
| GB | 1464056 | 2/1977 |
| WO | 2008/050206 | 5/2008 |

OTHER PUBLICATIONS

Italian Search Report dated Feb. 13, 2012 from counterpart application.
Notice of Allowance dated Jan. 31, 2014 from counterpart European App No. 12172345.
Reply to Examination Report dated Sep. 30, 2013 from counterpart European App No. 12172345.
EPO Communication dated Jun. 7, 2013 from counterpart European App No. 12172345.
Reply to Examination Report dated Dec. 14, 2012 from counterpart European App No. 12172345.
European Search Report dated Oct. 15, 2012 from counterpart European App No. 12172345.

* cited by examiner

*Primary Examiner* — Daniel V Venne
(74) *Attorney, Agent, or Firm* — Timothy J. Klima; Shuttleworth & Ingersoll, PLC

(57) ABSTRACT

An air intake device for a submarine comprises a first fixed member connected to the submarine hull and a second member which is telescopically movable relative to the first member to rise up with an upper end of it above the water's surface to allow air to be taken in from the atmosphere during navigation of the submarine at periscope depth, the movable member mounting at its upper end a radar device designed to emerge from the water together with the selfsame movable member.

7 Claims, 3 Drawing Sheets

AIR INTAKE DEVICE

This application claims priority to Italian Patent Application BO2011A000383 filed Jun. 29, 2011, the entirety of which is incorporated by reference herein.

BACKGROUND OF THE INVENTION

This invention relates to an air intake device.

The invention applies generally to the naval (or nautical) sector and, more specifically, to the production of military submarines, where these devices are universally known as snorkels.

In this description the term "snorkel" and its definition as "air intake device" will be used without distinction.

Still more specifically, the invention relates to an air intake device or snorkel combined with one or more other devices.

In conventional military submarines, the snorkel is designed to allow the submarine to remain hidden as far as possible, even during the recharging of the batteries used for submarine propulsion.

In effect, the snorkel is basically a tube that pierces the sea surface while the submarine is navigating below the surface but at a shallow depth (usually referred to as "snorkel depth" or "periscope depth"), in order to guarantee the supply of air necessary for operation of the internal combustion engines used to recharge the batteries, as well as for ventilation of the submarine quarters.

Although, in actual fact, snorkel depth and periscope depth may be slightly different, the term "periscope depth" will hereinafter be used in a general sense to refer to both periscope depth and snorkel depth without distinction.

The possibility of allowing only a tube, and not a bulkier part of the submarine, to emerge above the surface reduces the risk of detection during these operations, when the submarine is particularly vulnerable to enemy attacks.

The snorkel is therefore mounted and housed in a mast rising up above the water surface from the submarine hull in a substantially vertical direction during navigation at periscope depth.

Besides the snorkel, raising other devices, sensors and/or antennas, used for viewing and/or communication purposes, above the water's surface while keeping the boat as hidden as possible below the surface is a well-known need in the field of submarine design.

In this regard, it is known from document DE 195 35 873 the use of retractable masts provided of a vertical hydraulic cylinder having a piston rod vertically movable, a mast rod (having a profile generally favourable to the water flow) fixed to the piston rod and a generally known information device (for example a sensor or a radar) mounted on the upper end of said mast rod.

The retractile masts described in document DE 195 35 873 can also be used, alternatively to the lifting of information devices, with a snorkeling function.

Disadvantageously, as it can be simply understood, in the above kind of lifting devices (as in the majority of the known lifting devices) the number of retractile masts linearly increases with the enhancing of the devices number, in particular considering that at least one mast must be dedicated to the snorkeling function.

It is to be noted that the presence of an high number of elevated masts, not only makes the submarine easier to locate because their actual presence is visible but also has the disadvantage that, on piercing the water's surface, they create swirling near the surface and produce a mass of white water (or foam) and leave a clearly visible trail in their wake.

To limit the negative effects of this disadvantage, these devices and mechanisms have been combined with the sensors/antennas necessarily present on the submarine in such a way as to limit not only the number of parts moving above the surface but also their size.

In this regard, prior U.S. Pat. No. 7,209,288 deals with the problem by providing a snorkel device furnished not only with a snorkel tube proper but also with two compact units, one associated with optical observation means and the other with generic communications means. Both compact units are equipped with respective drive means.

The solution proposed by U.S. Pat. No. 7,209,288 is not itself free of disadvantages because the snorkel tube has to accommodate two additional drive systems, besides that of the snorkel itself, thus increasing the size of the part of the submarine that emerges above the water's surface during navigation at periscope depth.

In effect, the presence of the drive systems inside the mast that houses the snorkel necessarily implies increasing the size of the mast, which in turn means increasing the negative effects of water turbulence and wake formation.

A further drawback connected with the solution proposed in U.S. Pat. No. 7,209,288 is due to the fact that the permanent presence of the communications means in the snorkel mast makes it necessary to extend the snorkel mast even when only the communications means need to be used, thus producing a considerable wake even in situations where this is not strictly necessary.

SUMMARY OF THE INVENTION

This invention therefore has for an aim to overcome the above mentioned disadvantages by providing an air intake device or snorkel that allows an overall reduction of the visual impact of the submarine.

The technical features of the invention according to the aforementioned aim may be easily inferred from the content of the appended claims, especially claim 1, and preferably any of the claims that depend, either directly or indirectly, on claim 1.

BRIEF DESCRIPTION OF THE DRAWINGS

The advantages of this invention are more apparent from the detailed description which follows, with reference to the accompanying drawings which illustrate a non-limiting example embodiment of the invention, and in which:

FIG. 1 is a schematic side elevation view, with some parts cut away, showing a submarine part which the device according to the invention is mounted on;

DESCRIPTION OF THE PREFERRED EMBODIMENTS

Figure 1:
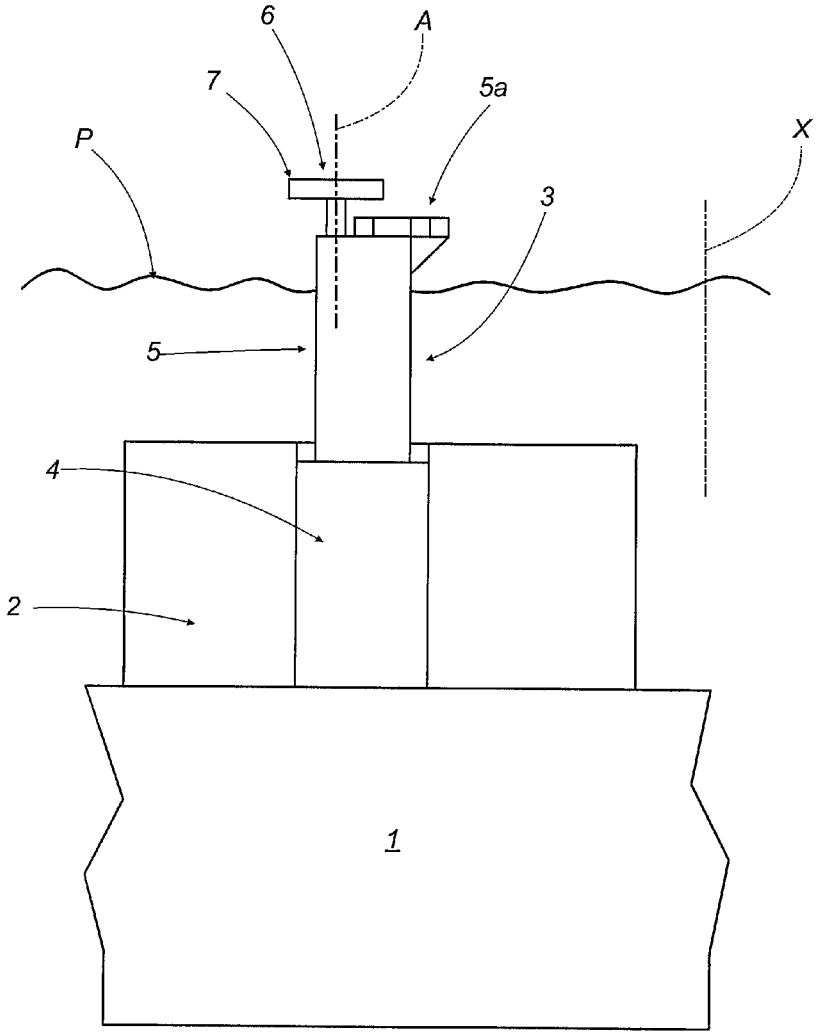

As illustrated in FIG. 1, the reference numeral 1 denotes a part of a submarine navigating at periscope depth (or snorkel depth), that is to say, with some parts, better described below, rising up above a surface P of the water.

The submarine 1 has a sail 2, or conning tower, in which the air intake device 3, also called snorkel, is installed.

The air intake device 3 comprises a fixed first tube 4 and a movable second tube 5.

The tubes 4 and 5 define for the device 3 a fixed first member and a movable second member, respectively.

The movable second tube 5 is slidably inserted in the fixed first tube 4 and is telescopically movable relative to it along a defined direction X, to rise up above the water during navigation at periscope depth.

Figure 2B:
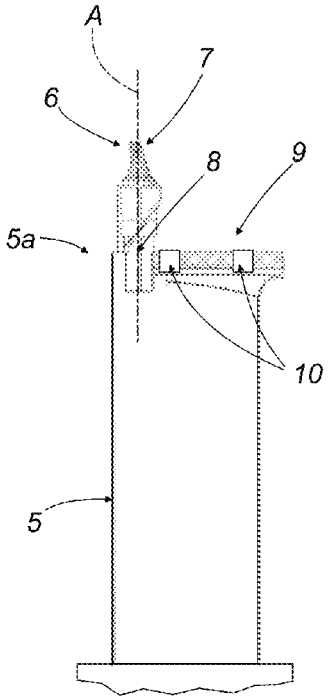
FIGS. 2*a* to 2*c* are respective schematic views showing a detail of the device according to the invention in different configurations of use.
Figure 2A:
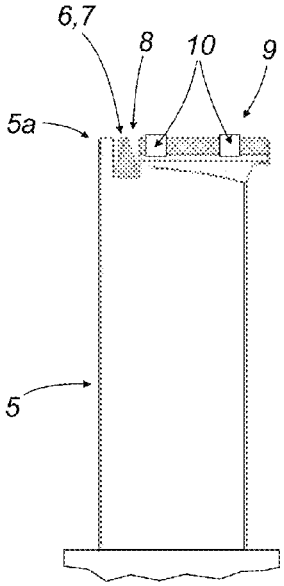
Figure 2C:
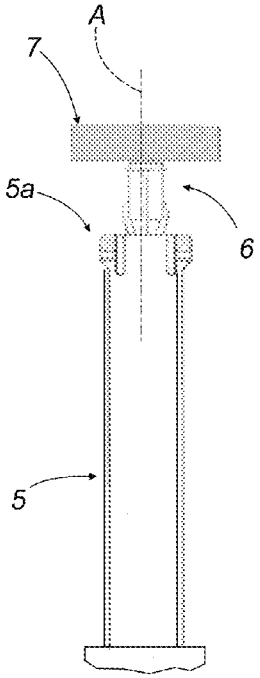

More specifically, the movable second tube 5 is movable between a first retracted end position (not illustrated in the accompanying drawings), where it is substantially housed inside the fixed tube 4, and an extended position, as illustrated by way of example in FIGS. 2*a* to 2*c*.

At an upper end 5*a*, or top, of the movable second tube 5, the air intake device 3 comprises a customary valve for selectively allowing air to be taken in.

Also according to prior art, the movable second tube 5 may be raised by hydraulic, electric, or pneumatic actuators.

With reference to the accompanying drawings, the movable second tube 5 has a radar device 6 mounted at the upper end 5*a*.

The radar device 6 comprises an antenna 7 which is rotatable about a respective axis of rotation A, substantially parallel to the direction X.

As illustrated in FIGS. 2*a*, 2*b*, 2*c*, the antenna 7 of the radar device 6 is movable along the defined direction X between a retracted, non-operating configuration of minimum dimensions, shown in FIG. 2*a*, and an extended, operating position, illustrated from two points of view, in FIGS. 2*b* and 2*c*.

More in detail, as illustrated in FIG. 2*a*, in its retracted, non-operating configuration, the antenna 7 of the radar device is housed in a specific compartment 8 made on the top 5*a* of the movable second tube 5.

As illustrated in the accompanying drawings, there is at least one optronic image capturing device 9 located on the top 5*a* of the movable second tube 5.

The optronic device 9 preferably includes four fixed video cameras 10.

Figure 3:
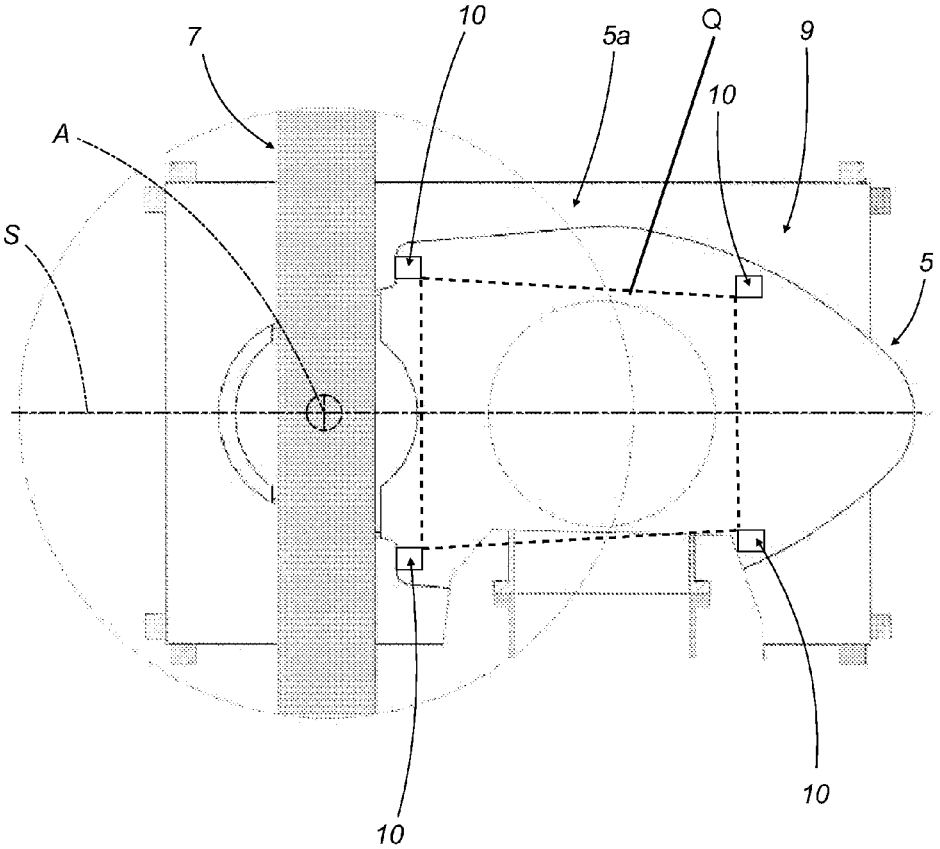
FIG. 3 is a schematic top plan view of the device of the preceding figures.

In the preferred embodiment illustrated, the four fixed video cameras 10 are advantageously mounted in a quadrilateral configuration whereby each video camera is positioned at a respective corner of an imaginary quadrilateral Q (see FIG. 3), so as to cover a viewing angle of 360°.

Advantageously, when the antenna 7 of the radar device 6 is in the extended operating configuration, it does not interfere with, or obstruct, the viewing field of the video cameras 10.

Advantageously, the axis of rotation A of the antenna 7 lies along an axis of symmetry S defined by the four video cameras.

Operatively, the antenna 7 is set in rotation by actuating means not illustrated, only when it is in its extracted, operating configuration.

When in the extracted, operating configuration, the antenna 7 of the radar device 6 rises up above all other parts.

In use, the air intake device 3 according to the invention allows the air intake function to be activated when the movable tube 5 is raised above the water's surface, as illustrated in FIG. 1.

From this configuration, the radar device 6 can be activated by moving the antenna 7 to its extended, operating configuration using a specific actuator not illustrated.

Advantageously, in the preferred embodiment illustrated, the optronic device 9 can provide images in a viewing field of 360° without interference from the radar device 6 or the antenna 7 of the radar device 6.

The invention achieves important advantages due to the snorkel and the radar device being combined in a single movable member, thereby overcoming some of the drawbacks of the prior art.

In effect, since use of the radar makes the submarine easier to locate, this instrument is advantageously combined with the snorkel so that air can be taken in whenever the radar is used, without jeopardizing the safety of the submarine.

Moreover, it has been experimentally observed that the radar is generally used more frequently when entering and leaving a port and on these occasions, definitely when leaving, the need to use the snorkel is certainly felt.

Thanks to the invention, therefore, the snorkel and the radar can be used in combination without unduly increasing the trackability and visual signature of the submarine.

Another advantage offered by the invention is that the snorkel does not have any communications system mounted in it. That means, advantageously, that the snorkel does not need to be raised when the communications systems have to be used, thus reducing the trackability of the submarine.

Yet another advantage of combining the snorkel with the radar and the optronic device constituted by the fixed video cameras is that it provides a comprehensive detecting system without substantially increasing the weight and dimensions of the snorkel tube with dedicated actuators for driving the video cameras.

The invention described above is susceptible of industrial application and may be modified and adapted in several ways without thereby departing from the scope of the inventive concept. Moreover, all details of the invention may be substituted by technically equivalent elements.

What is claimed is:

1. An air intake device for a submarine comprising:

a fixed first member connected to a hull of the submarine; and a movable second member arranged with respect to the fixed first member to be telescopically movable relative to the fixed first member, the movable second member being upwardly extendible relative to the fixed first member to a height where an upper end of the movable second member is positioned above a surface of water in which the submarine is submerged, when the submarine is at a periscope depth, to intake atmospheric air during navigation of the submarine at the periscope depth;

wherein the movable second member includes at the upper end a radar device mount arranged to move with the movable second member to position the radar device above the surface of water in which the submarine is submerged when the submarine is at the periscope depth.

2. The device according to claim 1, wherein the radar device mount is movable relative to the movable second member between at least one first, retracted, non-operating position and a second, extended, operating position.

3. The device according to claim 2, and further comprising at least one optronic device mounted at an upper end of the movable second member.

4. The device according to claim 3, wherein the optronic device includes four video cameras mounted in a quadrilateral configuration whereby each video camera is positioned at a respective corner of an imaginary quadrilateral.

5. The device according to claim 2, and further comprising at least one optronic device mounted at an upper end of the movable second member; wherein, when in the second, extended, operating position, the radar device mount positions the radar device on the movable second member to prevent viewing interference with the at least one optronic device.

6. The device according to claim 1, and further comprising at least one optronic device mounted at an upper end of the movable second member.

7. The device according to claim 6, wherein the optronic device includes four video cameras mounted in a quadrilateral configuration whereby each video camera is positioned at a respective corner of an imaginary quadrilateral.

* * * * *